United States Patent [19]

Wood

[11] 4,295,562

[45] Oct. 20, 1981

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 109,768

[22] Filed: Jan. 7, 1980

[51] Int. Cl.[3] ..... B65D 5/16; B65D 5/46; B65D 5/54

[52] U.S. Cl. ..... 206/158; 206/427; 206/628; 229/52 B

[58] Field of Search ..... 206/427, 140, 141, 158, 206/162, 193, 163, 628; 229/52 BC, 40

[56] References Cited

U.S. PATENT DOCUMENTS

| | | | |
|---|---|---|---|
| Re. 29,063 | 12/1976 | Graser | 206/141 |
| 3,090,520 | 5/1963 | Wuerthner | 206/140 |
| 3,356,258 | 12/1967 | Vesak | 206/628 |
| 3,750,935 | 8/1973 | Akkerman | 229/52 BG |
| 3,940,055 | 2/1976 | Rowley | 206/163 |
| 3,974,911 | 8/1976 | Graser | 206/141 |
| 4,103,770 | 8/1978 | Brandenburger et al. | 206/193 |
| 4,131,230 | 12/1978 | Koehlinger et al. | 206/158 |

*Primary Examiner*—William T. Dixson, Jr.
*Attorney, Agent, or Firm*—Rodgers & Rodgers

[57] ABSTRACT

An article carrier formed from a unitary blank and comprising a bottom wall (1), side wall means (2, 3, 32, 37) secured to the side edges of the bottom wall, a pair of end walls (20,53) secured respectively to the ends of the bottom wall, a top panel (30) secured to the upper edges of the side wall means and the end walls, a secondary bottom panel (6) secured to an end edge of the bottom wall and disposed in overlying relationship therewith, handle means (8, 11) secured to the secondary bottom panel and upstanding therefrom, and the top panel being removable with at least one V-shaped bend line (51,52) formed therein.

23 Claims, 8 Drawing Figures

ARTICLE CARRIER AND BLANK THEREFOR

TECHNICAL FIELD

This invention relates to article carriers which are economical to manufacture and at the same time are well adapted for use in connection with returnable primary packages.

BACKGROUND ART

Various methods have been utilized in the past in order to render conventional nonreturnable article carriers suitable for use in connection with returnable articles such as are currently widely accepted by the consuming public. An example of this type of carrier in one form is disclosed in U.S. Pat. No. 3,356,258. A recurring problem with these carriers is that whenever the carrier is opened to gain access to the articles, it is severely weakened which hampers or renders impossible its use in connection with returnables.

DISCLOSURE OF INVENTION

According to this invention in one form, an article carrier is provided and comprises a bottom wall with side wall means and end walls upstanding therefrom, a top panel secured to the upper edges of the side wall means and the end walls, at least a portion of the top panel being removable, a secondary bottom panel secured in overlying relationship with the bottom wall, and handle means secured to the secondary bottom panel and upstanding therefrom.

BEST MODE FOR CARRYING OUT THE INVENTION

Figure 4:
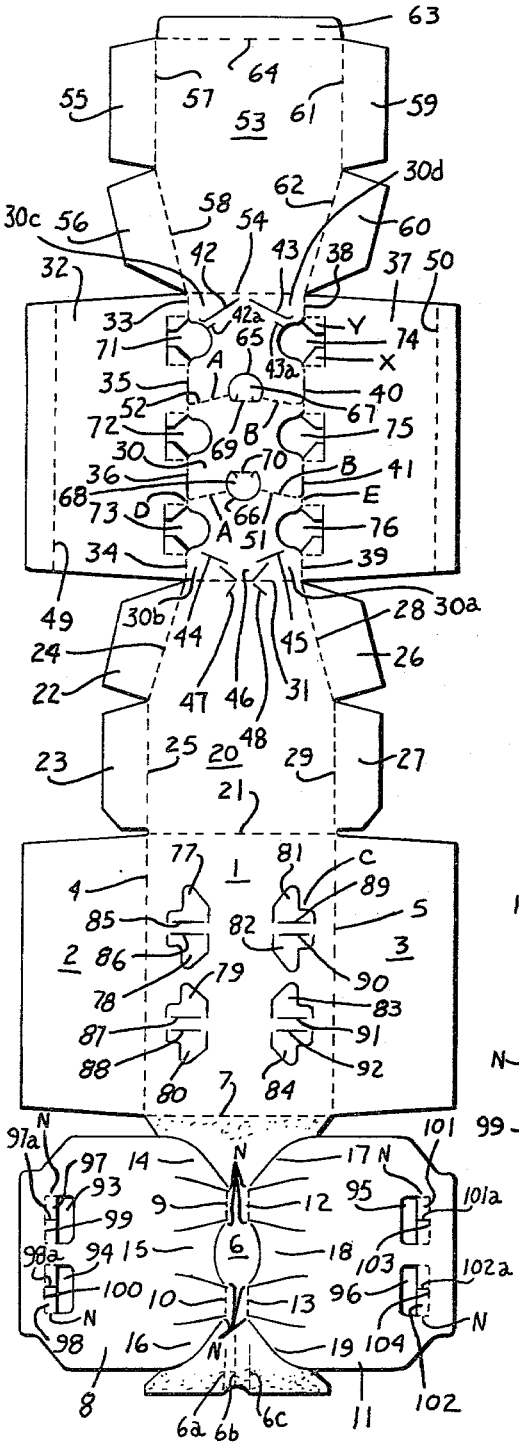
FIG. 4 is a plan view of the blank from which the carrier is formed.

With reference to the drawings and with particular reference to FIG. 4, the numeral 1 designates the bottom wall of the carrier to the side edges of which a portion of the side wall means in the form of lower side wall panels 2 and 3 is foldably joined along fold lines 4 and 5. To one end edge of bottom wall 1, secondary bottom panel 6 is foldably joined along fold line 7. In order to faciliate machine manipulation of the blank by eliminating some of the inherent stiffness in the paperboard material, bend lines 6*a*, 6*b*, and 6*c* are provided and are formed in secondary bottom panel 6.

Figure 5:
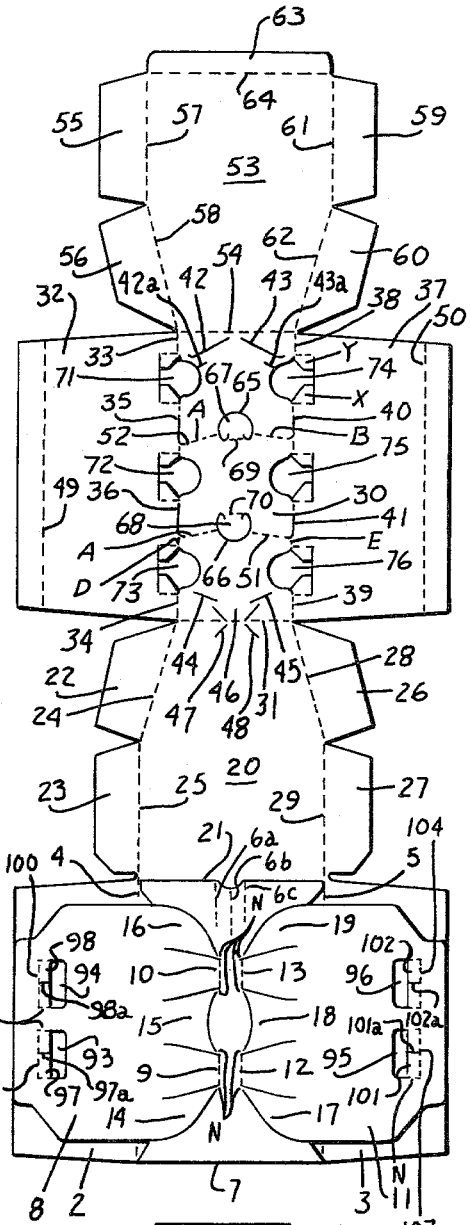
FIGS. 5 and 6 depict intermediate stages through which the blank shown in FIG. 4 is manipulated and glued in order to form a complete and collapsed carrier as shown in FIG. 7.

Handle means for the carrier is provided in the form of handle panel 8 which is foldably joined to one side of secondary bottom panel 6 along fold lines 9 and 10 and handle panel 11 which is foldably joined to the other side of secondary bottom panel 6 along fold lines 12 and 13. Since the midportion of secondary bottom panel 6 is somewhat narrow, it is apparent that the carrier handle means is struck, at least in part, from secondary bottom panel 6. Although two handle panels are shown in the drawings the handle means can also comprise only one handle panel. Formed along the lower portions of handle panels 8 and 11 is cushioning means for the purpose of separating the articles disposed in the transverse direction of the carrier. Specifically cushioning panels 14, 15 and 16 are formed along the lower portion of handle panel 8 and cushioning panels 17, 18 and 19 are formed along the lower portion of handle panel 11. As is apparent from FIGS. 4 and 5, the lower edges of the cushioning panels 14–19 are curved. This feature of the invention faciliates the smooth entry of the articles onto secondary bottom panel 6 during the article loading operation.

To the other end edge of bottom wall 1, end wall 20 is foldably joined along fold line 21. In addition flaps 22 and 23 are foldably joined respectively to end wall 20 along fold lines 24 and 25. Similarly flaps 26 and 27 are foldably joined respectively to end wall 20 along fold lines 28 and 29.

According to this invention in one form, top panel or top wall 30 is foldably joined to the upper edge of end wall 20 along interrupted fold line 31. Carrier side wall means includes upper side wall panel 32 which is joined to top panel 30 along fold lines 33 and 34 as well as along severance lines 35 and 36 and upper side wall panel 37 which is joined to top panel 30 along fold lines 38 and 39 as well as along severance lines 40 and 41. Also severance lines 42 and 43 are formed in top panel 30 at one end thereof and severance lines 44 and 45 are formed in top panel 30 at the other end thereof. In order to faciliate opening of the carrier, thumb tab 46 is formed in top panel 30 and, adjacent to thumb tab 46, cut lines 47 and 48 are formed in the upper portion of end wall 20. For use in connection with the gluing of the carrier, fold lines 49 and 50 are formed respectively in upper side wall panels 32 and 37.

According to another feature of this invention, V-shaped bend lines 51 and 52 are formed in top panel 30. Each of the V-shaped bend lines 51 and 52 comprises side elements A and B. As is apparent from FIG. 4, the side elements A and B of each V-shaped bend line 51 and 52 diverge in a direction toward thumb tab 46 which is the point at which removal of carrier top panel 30 is initiated. Additionally corner sections 30*a*, 30*b*, 30*c*, and 30*d* are disposed at the respective corners of top panel 30.

To complete the basic elements of the blank, end wall 53 is foldably joined to an end edge of top panel 30 along fold line 54. Flaps 55 and 56 are foldably joined respectively to end wall 53 along fold lines 57 and 58. Likewise flaps 59 and 60 are foldably joined respectively to end wall 53 along fold lines 61 and 62. In addition glue flap 63 is joined to end wall 53 along fold line 64.

For the purpose of facilitating transport of the carrier, finger gripping apertures 65 and 66 are formed in top panel 30 and are defined by cushioning tabs 67 and 68 which are foldably joined respectively to top panel 30 along fold lines 69 and 70. To receive the necks of the packaged articles, neck receiving apertures 71–76 are provided. For the purpose of insuring proper tearing of top panel 30, slits 42*a* and 43*a* are formed respectively on the periphery of neck receiving apertures 71 and 74. In order to reduce the amount of light which enters the carrier, a pair of tabs X and Y are associated with each neck receiving aperture.

To properly cushion and separate the heels of adjacent articles disposed in the longitudinal direction of the carrier, cushioning tabs 77–84 are provided and are foldably joined respectively to bottom wall 1 along fold lines 85–92. In addition each cushioning tab is provided with cutaway portion C, the purpose of which is described and claimed in U.S. patent application Ser. No. 933,488 filed Aug. 14, 1978 and which is owned by the assignee of this invention.

Finger gripping apertures 93 and 94 are formed in handle panel 8 and, similarly, finger gripping apertures 95 and 96 are formed in handle panel 11. Also cushioning flaps 97 and 98 are foldably joined respectively to handle panel 8 along fold lines 99 and 100. In like fashion, cushioning flaps 101 and 102 are foldably joined respectively to handle panel 11 along fold lines 103 and 104. Cuts 97*a*, 98*a*, 101*a*, and 102*a* are formed respectively in cushioning flaps 97, 98, 101 and 102. According to a feature of this invention, finger gripping aperture 94 is slightly larger in size than corresponding finger gripping aperture 96 and, likewise, finger gripping aperture 95 is slightly larger in size than corresponding finger gripping aperture 93.

To maintain the various elements of the blank in the proper relative positions during formation of the carrier, nicks N are provided at the lowermost points of cushioning panels 14–19 as well as along the outer edges of cushioning flaps 97, 98, 101, and 102. Nicks N simply constitute small paperboard connections between adjacent elements of the blank and are easily broken whenever the carrier is loaded or transported.

In order to form the carrier from the blank shown in FIG. 4, initially it is necessary to make an application of glue to secondary bottom panel 6 as shown by stippling in FIG. 4. Then secondary bottom panel 6 together with handle panels 8 and 11 are elevated and folded over along fold line 7 to occupy the positions shown in FIG. 5. By this operation secondary bottom panel 6 is adhered to the upper surface of bottom wall 1.

Figure 6:
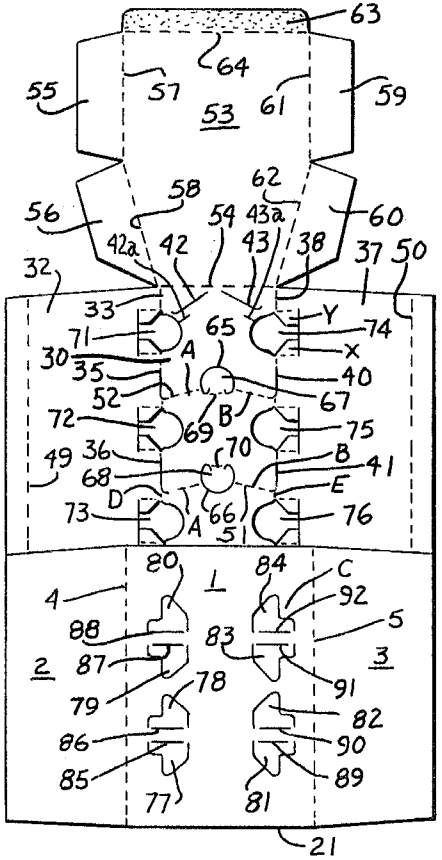

Following this operation, bottom wall 1 together with secondary bottom panel 6 and handle panels 8 and 11 are all elevated and folded over along fold line 21 to occupy the positions shown in FIG. 6. Then an application of glue is made to glue flap 63 as shown by stippling in FIG. 6. Thereafter end wall 53 and the associated structure are elevated and folded over along fold line 54 to occupy the positions shown in FIG. 7. By this operation, glue flap 63 is adhered to bottom wall 1.

Figure 8:
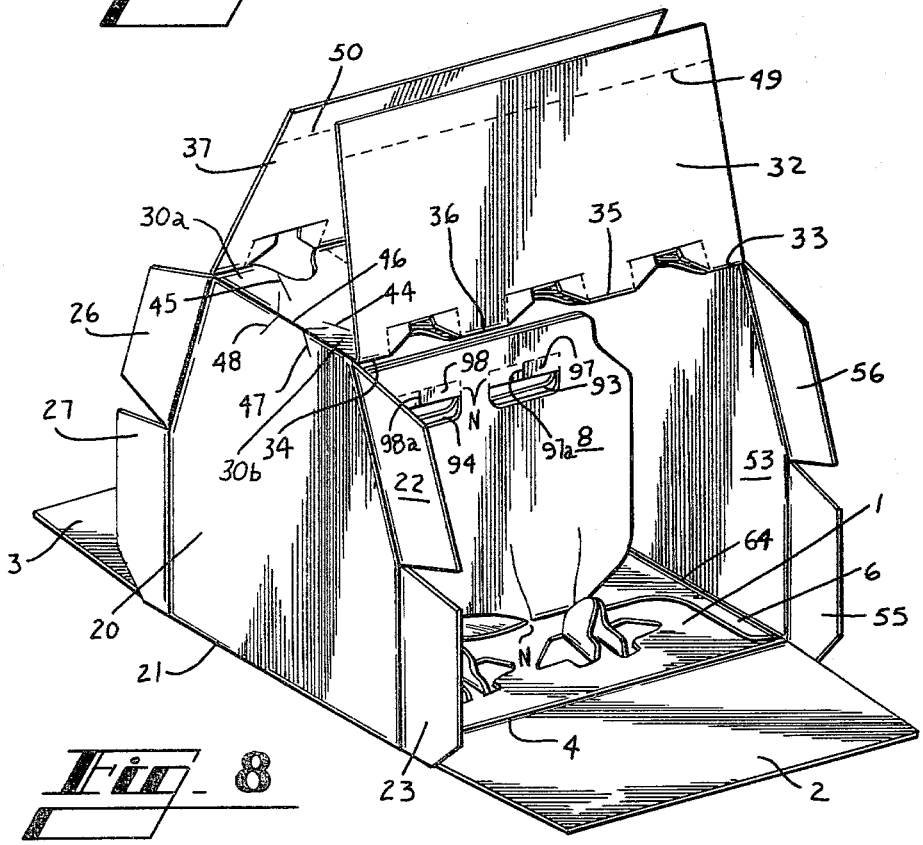
FIG. 8 is an isometric view of the carrier disposed in a condition appropriate for loading the articles therein.
Figure 7:
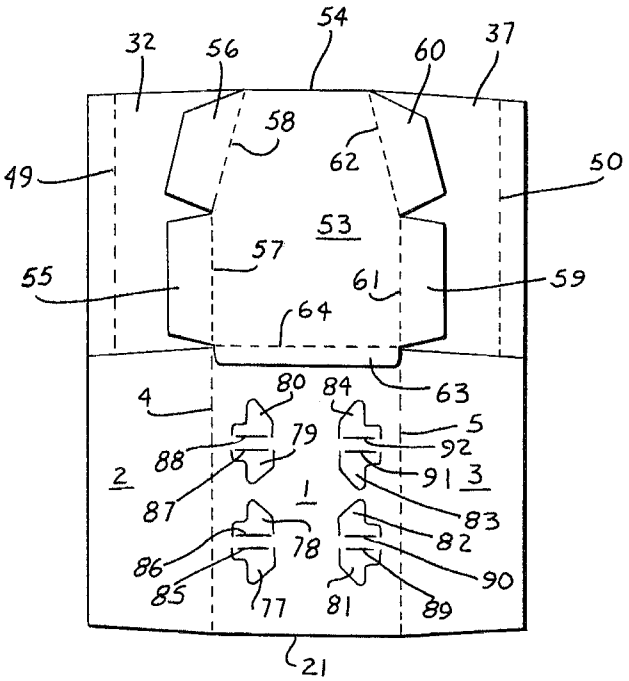

In order to set up the carrier from the collapsed condition shown in FIG. 7, it is simply necessary to manipulate the blank into a position whereby the end walls are parallel to each other and, likewise, whereby the top panel and bottom wall are also parallel to each other. Following this handle panels 8 and 11 are swung upwardly into vertical positions whereby they are disposed substantially perpendicular to bottom wall 1 and secondary bottom panel 6. Also cushioning tabs 77–84 are elevated into vertical positions. Then upper side wall panels 32 and 37 are swung upwardly into substantially vertical positions and lower side wall panels 2 and 3 are manipulated into horizontal positions. The carrier then appears as shown in FIG. 8.

Figure 1:
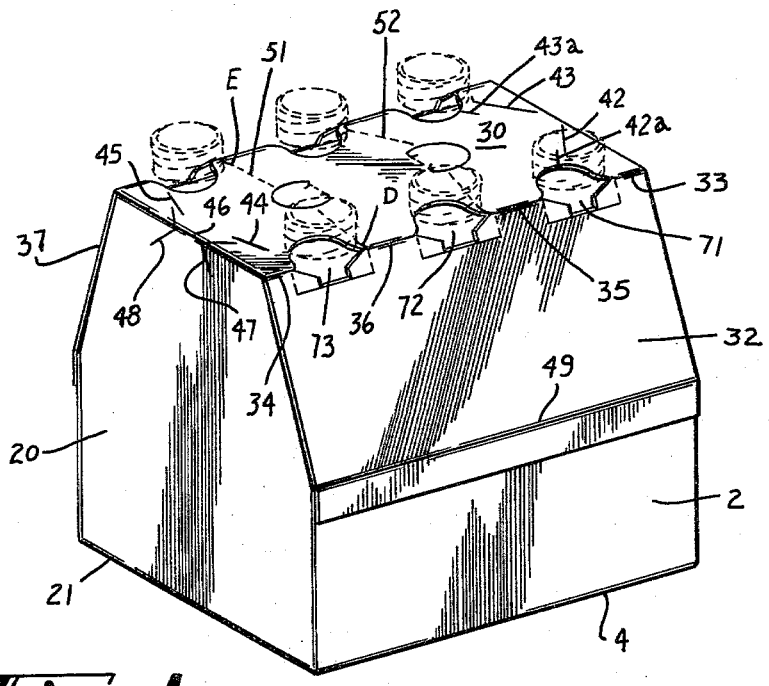
FIG. 1 is an isometric view of an article carrier formed according to this invention.
Figure 2:
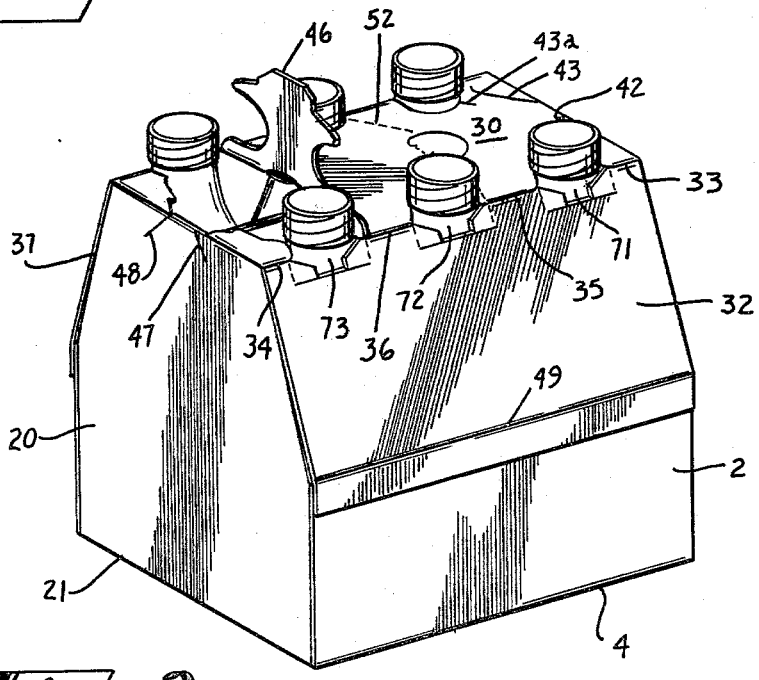
FIG. 2 is an isometric view of the carrier with a portion of the top panel partially removed.

In order to load the carrier, articles are guided into the article cells by means of appropriate article loading machinery. Subsequent to this flaps 22, 23, 26, 27, 55, 56, 59 and 60 are swung inwardly of the carrier and glue is applied to flaps 23, 27, 55 and 59. Thereafter lower side wall panels 2 and 3 are elevated and secured to the associated flaps. Then upper side wall panels 32 and 37 are lowered and, generally simultaneously with this operation, the ends thereof are rotated outwardly approximately 180° along fold lines 49 and 50 respectively. Glue is then applied to the exposed end portions of upper side wall panels 32 and 37 which are then rotated into a glued relationship with the respective lower side wall panels 2 and 3. The carrier then appears as shown in FIG. 1.

Figure 3:
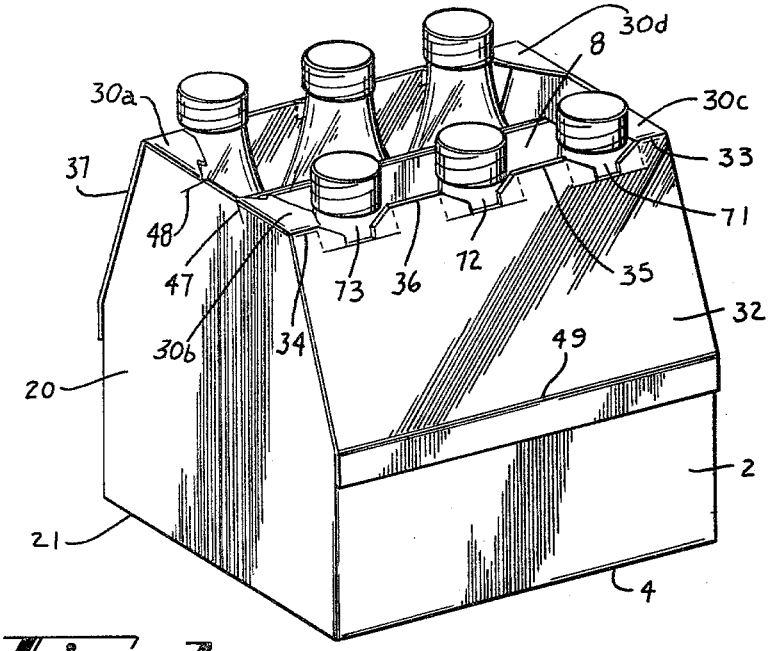
FIG. 3 is an isometric view of the carrier with a portion of the top panel completely removed.

In order to open the carrier for removal of the packaged articles, it is simply necessary to grasp thumb tab 46 and to pull top panel 30 upwardly. By this operation the inner portion of top panel 30 is severed along severance lines 44, 45, 36, 41, 35, 40, 42 and 43 and slits 42*a* and 43*a*. The carrier then appears as shown in FIG. 3.

When the inner portion of top panel 30 is removed, tearing thereof in a manner other than along the desired severance lines is prevented by means of V-shaped bend lines 51 and 52. As the removal of top panel 30 is initiated by the lifting of thumb tab 46 and tearing along severance lines 44 and 45, the V-shaped orientation of V-shaped bend line 51 causes the portions of top panel 30 on either side of side elements A and B to form upwardly diverging relationships therefrom. This in turn causes a tension force at points D and E along the side edges of top panel 30 at which points tearing is caused to occur and then continue along severance lines 36 and 41. Therefore by this invention any undesired tearing of top panel 30 is prevented especially as commonly occurs about the inner edges of the associated neck receiving apertures such as elements 73 and 76. The same structural relationships exist in connection with V-shaped bend line 52.

Therefore after the removable portion of top panel 30 has been discarded, the articles are removed and the contents thereof consumed as desired. The empty articles can then simply be placed into the carrier which is conveniently returned to the point of purchase by proper utilization of the handle means in the form of handle panels 8 and 11. Since at least a portion of the bottom of each article is disposed on secondary bottom panel 6, added reinforcement is achieved when the carrier is lifted by means of handle panels 8 and 11. Further strength is achieved by means of corner sections 30*a*, 30*b*, 30*c* and 30*d* which operate to connect upper side wall panels 32 and 37 to end walls 20 and 53.

According to another feature of this invention, finger gripping aperture 94 is somewhat larger in size than corresponding finger gripping aperture 96. As cushioning flap 98 is forced into finger gripping aperture 96, it tends to bind against the sides of finger gripping aperture 96 since it is slightly wider. Therefore handle panels 8 and 11 are locked in upright positions and do not separate and interfere with removal and replacement of the articles. Of course if the user's fingers are inserted through the other side of the handle means, the same relationship exists in the opposite direction between finger gripping aperture 95 and finger gripping aperture 93.

INDUSTRIAL APPLICABILITY

By this invention an article carrier is provided which is extremely strong, durable and economical and at the same time can be conveniently opened and reused in connection with returnable articles.

I claim:

1. An article carrier comprising a bottom wall (1), side wall means (2,3,32,37) secured to the side edges of said bottom wall, a pair of end walls (20,53) secured respectively to the ends of said bottom wall, a top panel (30) secured to said side wall means and said end walls and disposed substantially parallel to said bottom wall, and characterized by a secondary bottom panel (6) disposed in flat face contacting relation with the upper surface of said bottom wall, and handle means (8,11) struck at least in part from said secondary bottom panel and secured thereto and disposed substantially perpendicular thereto.

2. An article carrier according to claim 1 and further characterized by the fact that said handle means comprises a pair of handle panels.

3. An article carrier according to claim 2 and further characterized by a pair of finger gripping apertures (93,94,95,96) formed in each of said handle panels, a pair of cushioning flaps (97,98,101,102) foldably joined to each of said handle panels and disposed respectively in said finger gripping apertures, and one of said finger gripping apertures in each of said handle panels being larger in size than the corresponding finger gripping aperture in the other handle panel.

4. An article carrier according to claim 2 and further characterized by cushioning means (14–19) formed along the lower portion of each of said handle panels.

5. An article carrier according to claim 4 and further characterized by the fact that the lower edges of said cushioning means are curved.

6. An article carrier according to claim 4 and further characterized by a plurality of nicks (N) interconnecting said cushioning means and adjacent portions of the blank.

7. An article carrier according to claim 1 and further characterized by an article disposed on one side of said handle means and at least a portion of the bottom of said article being disposed on said secondary bottom panel.

8. An article carrier according to claim 1 and further characterized by the fact that said secondary bottom panel is foldably joined to an end edge of said bottom wall.

9. An article carrier according to claim 1 and further characterized by said secondary bottom panel being secured to the upper surface of said bottom wall.

10. An article carrier having a bottom wall (1), side wall means (2,3,32,37) secured to the side edges of said bottom wall, a pair of end walls (20,53) secured respectively to the ends of said bottom wall, a top panel (30) secured to said side wall means and said end walls and disposed substantially parallel to said bottom wall, and characterized by the fact that at least a portion of said top panel is removable, and a V-shaped bend line (51,52) is formed in said top panel, said V-shaped bend line comprising side elements (A,B) diverging toward the end of said top panel whereat removal thereof is initiated.

11. An article carrier according to claim 10 and further characterized by a pair of severance lines (35,36,40,41) disposed respectively along the side edges of said top panel.

12. An article carrier according to claim 11 and further characterized by a thumb tab (46) disposed at the end of said top panel whereat the removal thereof is initiated.

13. An article carrier according to claim 12 and further characterized by a pair of severance lines (42,43) formed in said top panel remote from said thumb tab.

14. An article carrier according to claim 13 and further characterized by a pair of neck receiving apertures formed in said top panel adjacent said pair of severance lines formed in said top panel and a pair of slits (42*a*,43*a*) formed respectively on the peripheries of said pair of neck receiving apertures.

15. An article carrier according to claim 10 and further characterized by a secondary bottom panel (6) disposed in flat face contacting relationship with the upper surface of said bottom wall.

16. An article carrier according to claim 15 and further characterized by handle means (8,11) secured to said secondary bottom panel and disposed substantially perpendicular thereto.

17. An article carrier blank comprising a top panel (30), a pair of end walls (20,53) foldably joined respectively to the end edges of said top panel, a bottom wall (1) foldably joined to one of said end walls remote from said top panel, and characterized by a secondary bottom panel (6) foldably joined to said bottom wall remote from said one end wall, and handle means (8,11) foldably joined to said secondary bottom panel.

18. An article carrier blank according to claim 17 and further characterized by the fact that said handle means comprises one handle panel foldably joined to said secondary bottom panel along one side thereof and another handle panel foldably joined to said secondary bottom panel along the other side thereof.

19. An article carrier blank according to claim 17 and further characterized by a pair of upper side wall panels (32,37) foldably joined respectively to the side edges of said top panel and a pair of lower side wall panels (2,3) foldably joined respectively to the side edges of said bottom wall.

20. An article carrier blank according to claim 17 and further characterized by a V-shaped bend line (51,52) formed in said top panel.

21. An article carrier comprising a bottom wall (1), a pair of lower side wall panels (2,3) secured respectively to the side edges of said bottom wall, a pair of end walls (20,53) secured respectively to the ends of said bottom wall, a top panel (30) secured to the upper edges of said end walls and with at least a portion thereof being removable, a pair of upper side wall panels (32,37) secured respectively to the side edges of said top panel with the lower portions thereof disposed respectively in overlapping relationship with the upper portions of said lower side wall panels, corner sections (30*a*,30*b*,30*c*,30*d*) disposed respectively in said top panel at the corners thereof for the purpose of connecting portions of said upper side wall panels and said end walls following removal of at least a portion of said top panel, and characterized by a V-shaped bend line (51,52) formed in said top panel.

22. An article carrier according to claim 21 and further characterized by the fact that said upper side wall panels are secured respectively to said lower side wall panels.

23. An article carrier according to claim 21 and further characterized by a pair of fold lines (49,50) formed respectively in said upper side wall panels adjacent the lower edges thereof.

* * * * *